United States Patent [19]

Kakuda

[11] Patent Number: 5,048,262

[45] Date of Patent: Sep. 17, 1991

[54] PROTECTIVE SHEET, PHOTOSENSITIVE SHEET FILM PACKAGING METHOD AND PACKAGE OF PHOTOSENSITIVE SHEET FILM

[75] Inventor: Tsunenari Kakuda, Shizuoka, Japan

[73] Assignee: Fuji Photo Film Co., Ltd., Kanagawa, Japan

[21] Appl. No.: 565,903

[22] Filed: Aug. 10, 1990

Related U.S. Application Data

[63] Continuation of Ser. No. 268,974, Nov. 9, 1988, abandoned.

[30] Foreign Application Priority Data

Nov. 11, 1987 [JP] Japan ..... 62-284452

[51] Int. Cl.[5] ..... B65B 29/00

[52] U.S. Cl. ..... 53/401; 53/472

[58] Field of Search ..... 53/401, 472, 447

[56] References Cited

U.S. PATENT DOCUMENTS

| | | | |
|---|---|---|---|
| 3,443,093 | 5/1969 | Lindenmuth et al. | 206/455 |
| 3,458,033 | 7/1969 | Kenji et al. | 206/455 |
| 4,093,069 | 6/1978 | Smolderen | 206/455 |
| 4,160,503 | 7/1979 | Ohlbach | 206/334 |
| 4,214,031 | 7/1980 | Miyakawa et al. | 428/213 |
| 4,327,174 | 4/1982 | von Meer | 428/508 |
| 4,356,224 | 10/1982 | Akao et al. | 206/455 |
| 4,438,164 | 3/1984 | Pfeifer et al. | 428/35 |
| 4,480,747 | 11/1984 | Kazor et al. | 206/334 |
| 4,513,050 | 4/1985 | Akao | 428/200 |
| 4,528,222 | 7/1985 | Rzepecki et al. | 206/334 |
| 4,778,713 | 10/1988 | Akao | 206/455 |

FOREIGN PATENT DOCUMENTS 5640535 9/1979 Japan .

*Primary Examiner*—John Sipos

*Attorney, Agent, or Firm*—Burns, Doane, Swecker & Mathis

[57] ABSTRACT

A protective sheet used for packaging silver halide photographic sensitive sheet films. The protective sheet comprises a low electrification paper material formed of natural pulp paper impregnated with an inorganic salt of alkali metal in an amount of 0.01-40 g/m$^2$. A method of packaging a stack of a plurality of photosensitive sheet films and a photosensitive sheet film package is also disclosed.

1 Claim, 1 Drawing Sheet

PROTECTIVE SHEET, PHOTOSENSITIVE SHEET FILM PACKAGING METHOD AND PACKAGE OF PHOTOSENSITIVE SHEET FILM

This application is a continuation of application Ser. No. 268,974, filed Nov. 9, 1988 now abandoned.

BACKGROUND OF THE INVENTION

1. Field of the Invention

The present invention relates to a protective sheet for use in packaging silver halide photographic sensitive sheet films, such as X-ray photographic films, lithographic films, cut films, or the like, such films each including a fluorine surfactant and a matting agent in the outermost layer, and relates to a packaging method and package using such a protective sheet.

2. Description of the Prior Art

Conventionally, when a stack of silver halide photographic sheet films each including a fluorine surfactant and a matting agent in the outermost layer are packed in a bag, the silver halide photographic photosensitive sheet films are charged in padding cardboards so a to prevent the silver halide photographic sensitive sheet films from being bent or broken in inserting the films into the bag, in transportation of the bag or in use of the bag, and to protect the silver halide photographic sensitive sheet films from being knocked about during transportation. That is, a stack of silver halide photographic sensitive sheet films are charged between flat padding cardboards 8 as shown in FIG. 4 or in a padding cardboard 9 bent in a U-shape as shown in FIG. 5, and then are put into a bag to complete a package (for example, Japanese Utility Model Unexamined Publication No. 56-40535).

As a paper material for such a protective sheet, a single layer of paper as shown in the diagram (a) of FIG. 2, combination paper having a multilayer arrangement of front and rear layers 5 and an intermediate layer 6 as shown in the diagram (b) of FIG. 2, or any of the above-mentioned paper laminated with thermoplastic resin 7 as shown in the diagram (a) or (b) of FIG. 3 has been used.

The foregoing known protective sheets, however, have a disadvantage in that when a stack of silver halide photographic sensitive sheet films each including a fluorine surfactant and a mat agent in the outermost layer are packaged, static electricity is generated by friction or the like between the protective sheet and the stack of silver halide photographic sensitive sheet films which can generate static marks.

Further, a package in which silver halide photographic sensitive sheet films each having a fluorine surfactant for preventing static electricity from occurring are packed with such a protective sheet has a disadvantage in that the fluorine surfactant is transferred from the surface of each silver halide photographic sensitive sheet film to the protective sheet which deteriorates the static electricity generation-preventing capability of each silver halide photographic sensitive sheet film over time and before the package has reached the end user.

OBJECTS AND SUMMARY OF THE INVENTION

An object of the present invention is to provide a protective sheet in which the foregoing disadvantages are eliminated, a method of packaging silver halide photographic sensitive sheet films each including a fluorine surfactant and a matting agent in the outermost layer by using such a protective sheet, and a package of the same.

DESCRIPTION OF THE PREFERRED EMBODIMENTS

Figure 1:
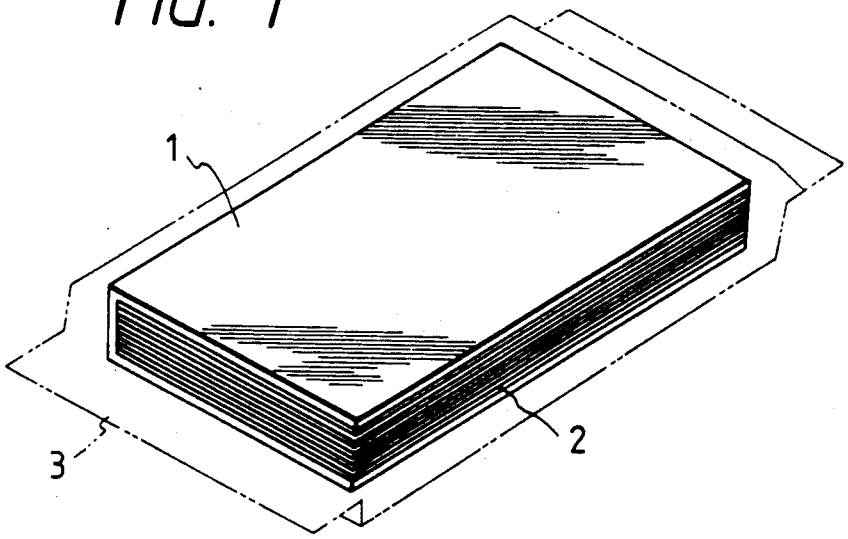
FIG. 1 is a diagram showing an embodiment of the package of silver halide photographic photosensitive sheet films each containing a matting agent and a fluorine surfactant in the outermost layer according to the present invention.
Figure 2A:
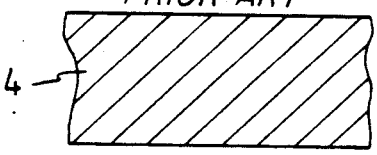
FIG. 2(a) PRIOR ART
FIGS. 2 through 5 are diagrams showing conventional examples. In the drawings, reference numeral 1 represents a protective sheet, reference numeral 2 represents photosensitive sheet film and reference numeral 3 represents a bag.
Figure 2B:
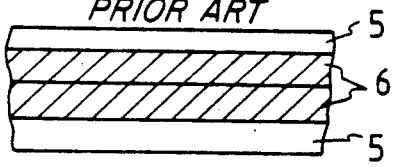
FIG. 2(b) PRIOR ART
Figure 3A:
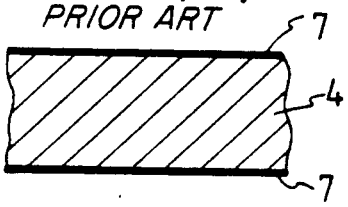
FIG. 3(a) PRIOR ART
Figure 3B:
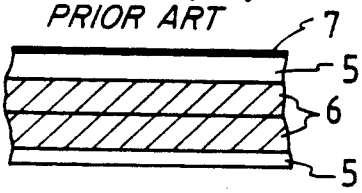
FIG. 3(b) PRIOR ART
Figure 4:
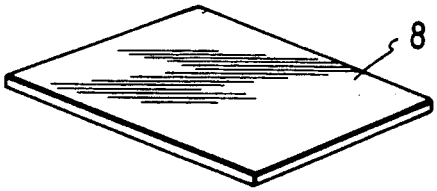
FIG. 4 PRIOR ART
Figure 5:
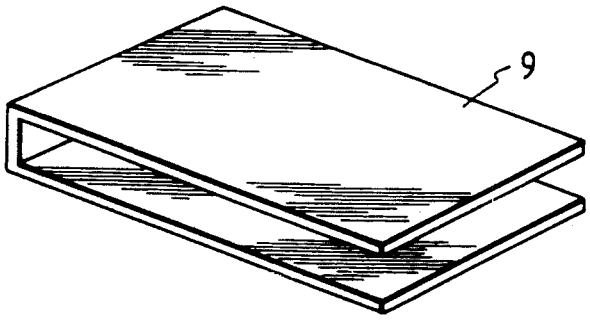
FIG. 5 PRIOR ART

The present invention has attained the foregoing objects, and has achieved a method of producing a protective sheet in which generation of static electricity is prevented wherein a natural pulp paper material is used as the protective sheet.

In order to prevent generation of static electricity, it is necessary to make the surface electric resistance of paper low. For this purpose, an antistatic agent is contained within the paper layer or the whole paper layer is impregnated with an antistatic agent by a size pressing process after the paper is made.

Although any widely known material may be used as a raw material for the antistatic agent, it is necessary to select a material having no influence on a photosensitive material and to adjust the quantity of the material to fall within a range permissible in practical use.

As the raw material for the antistatic agent, an inorganic salt compound of alkali metal such as NaCl, $Na_2SO_4$ ... may be used. The preferable quantity is 0.01–40 $g/m^2$ because the quantity smaller than 0.01 $g/m^2$ is insufficient while any quantity above 40 $g/m^2$ is not necessary to perform the desired function.

The preferred weight of the protective sheet is 150–700 $g/m^2$ because a weight lower than 150 $g/m^2$ is insufficient while a weight of above 700 $g/m^2$ is not necessary to perform the desired function.

The preferred water content of the protective sheet is 3.5–8.5% by weight because the protective sheet generates paper powder if the water content is smaller than 3.5% while the silver halide photographic photosensitive sheet film containing a matting agent in the outermost layer and a fluorine surfactant can stick to the protective sheet if the water content is not smaller than 8.5%.

The most suitable packaging atmosphere in a place where silver halide photographic photosensitive sheet films each containing a matting agent in the outermost layer and a fluorine surfactant are packed with the protective sheet is under conditions in which the temperature is 20°–30° C. and the relative humidity is 40–70% RH.

Under the conditions in which the temperature is lower than 20° C. and the relative humidity is lower than 40%, static electricity is generated by friction between the silver halide photographic photosensitive sheet films or by rubbing between the silver halide photographic photosensitive sheet films and the packaging equipment, so that static marks are generated or paper powder is generated from the protective sheet which may cause the occurrence of scratches or the like.

Further, under the conditions in which the temperature is not lower than 30° C. and the relative humidity is not lower than 70% RH, the protective sheet can stick to the silver halide photographic photosensitive sheet films which may cause an impermissible problem in practical use.

The protective sheet according to the present invention is impregnated with an alkali metal inorganic salt compound to thereby prevent generation of static electricity, so that generation of static electricity by friction or the like in packaging a stack of silver halide photographic photosensitive sheet films each containing a mat agent in the outermost layer and a fluorine surfactant can be so reduced that static marks can be completely prevented from occurring.

Further, in the package of silver halide photographic photosensitive sheet films using the protective sheet, the transfer of the fluorine surfactant from the surfaces of the silver halide photographic photosensitive sheet films in which generation of static electricity is prevented by the fluorine surfactant can be prevented by the action of the alkali metal inorganic salt compound. It is therefore possible to maintain the prevention of static electricity generation for a long time, so that the film can be stored for a long period of time without the generation of static marks.

EXAMPLES

Natural pulp paper was manufactured in the form of a single layer paper having a weight of 450 g/m$^2$ by using a Fourdrinier machine, and then impregnated with 9 g/m$^2$ of $Na_2SO_4$ by the size press method so as to finish the paper which had a water content of 6.5%.

The thus prepared paper was subjected to die-cutting so as to be formed into a U-shaped protective sheet. A stack of 100 sheets of X-ray photographic film each having a size of 35.6 cm×43.2 cm and containing a mat agent and a fluorine surfactant in the outermost layer were padded with the protective sheet and packed in a bag as shown in FIG. 1 in an atmosphere in which the temperature and humidity conditions upon packing were set at 25° C. and 60% RH respectively.

The package was carried into a clean room in which the atmosphere was controlled so that the temperature was 25° C. and the humidity was 60% RH, and the quantity of charge due to rubbing between the protective sheet and the X-ray photographic films and surface electric resistance of the protective sheet were measured.

Further, the X-ray photographic films were subjected to exposure and development so as to make the density be 0.8±0.2 to thereby confirm generation of static marks.

Compared with the experiment using a conventional protective sheet having no impregnation with $Na_2SO_4$ prepared by the same method as that of the example of the invention, the aforementioned example of the invention showed such an effect that the surface electric resistance was smaller than that of the conventional protective sheet and the quantity of generated static electricity was remarkably reduced so that no static marks were generated, as seen in the following table 1.

TABLE 1

| | Charge due to rubbing between protective sheet and X-ray film | Surface resistance of protective (value of log SR) | Generation of static marks in 100 sheets of 35.6 cm × 43.2 cm |
|---|---|---|---|
| Conventional protective sheet | $-4.0 \times 10^{-8}$ coulomb | 11.7 | Yes |
| Protective sheet impregnated with $Na_2SO_4$ 9 g/m$^2$ | $-1.0 \times 10^{-8}$ coulomb | 8.5 | No |

Further, the above-mentioned package prepared under the foregoing conditions was preserved for six months in a storehouse in which the air-conditioning conditions were controlled so that the temperature was 25°±2° C. and the humidity was 60±5% RH, and the quantity of the fluorine surfactant transferred from the X-ray photographic films to the protective sheet in the package was then measured.

Compared with the conventional protective sheet having no impregnation with $Na_2SO_4$ prepared by the same method as that of the example of the invention, the aforementioned example of the invention showed a remarkable effect wherein the quantity of transferred fluorine surfactant was smaller than that of the conventional protective sheet, as seen in the following table 2.

TABLE 2

| | Quantity of transferred fluorine surfactant (counts of fluorine element) |
|---|---|
| Before packing of protective sheet | 2000 |
| Conventional protective sheet | 950 |
| Protective sheet impregnated with $Na_2SO_4$ 9 g/m$^2$ | 1900 |

What is claimed is:

1. A method of packing a stack of a plurality of photosensitive sheet films, each including a fluorine surfactant, with a protective sheet, comprising the steps of:

providing a stack of a plurality of photosensitive sheet films, each including a fluorine surfactant;

preparing said protective sheet comprised of a low electrification paper material formed of natural pulp paper impregnated with an inorganic salt of alkali metal in an amount of 0.01–40 g/m$^2$, said protective sheet having a weight of 150–700 g/m$^2$ and a water content of 3.5–8.5%;

regulating an ambient temperature of 20°–30° C. and relative humidity to 40–70% RH; and packing said stack with said protective sheet.

* * * * *